US012276169B2

(12) United States Patent
Hult et al.

(10) Patent No.: US 12,276,169 B2
(45) Date of Patent: Apr. 15, 2025

(54) TUBING HANGER AND WELLHEAD ASSEMBLY WITH TUBING HANGER

(71) Applicant: EVOLUTION OIL TOOLS INC., Calgary (CA)

(72) Inventors: Vern Hult, Calgary (CA); Bernard Lumori, Calgary (CA); Chris Patton, Calgary (CA); Emery Stoesser, Calgary (CA)

(73) Assignee: Evolution Oil Tools Inc., Calgary (CA)

( * ) Notice: Subject to any disclaimer, the term of this patent is extended or adjusted under 35 U.S.C. 154(b) by 0 days.

(21) Appl. No.: 18/464,992

(22) Filed: Sep. 11, 2023

(65) Prior Publication Data

US 2024/0018841 A1 Jan. 18, 2024

Related U.S. Application Data

(63) Continuation-in-part of application No. 17/953,724, filed on Sep. 27, 2022, now Pat. No. 12,084,938.

(60) Provisional application No. 63/334,440, filed on Apr. 25, 2022, provisional application No. 63/276,076, filed on Nov. 5, 2021, provisional application No. 63/249,873, filed on Sep. 29, 2021, provisional application No. 63/250,027, filed on Sep. 29, 2021.

(51) Int. Cl.
*E21B 33/04* (2006.01)

(52) U.S. Cl.
CPC ..... *E21B 33/0415* (2013.01)

(58) Field of Classification Search
CPC ..... E21B 33/0415
See application file for complete search history.

(56) References Cited

U.S. PATENT DOCUMENTS 3,043,371 A * 7/1962 Rector ..... E21B 34/02 166/97.1
4,202,410 A * 5/1980 Quebe ..... E21B 33/04 166/88.4
4,278,278 A 7/1981 Chambless et al.
4,291,768 A * 9/1981 Diehl ..... F16J 15/185 166/88.4
4,384,730 A * 5/1983 Diehl ..... F16J 15/0881 277/626
5,456,321 A * 10/1995 Shiach ..... E21B 33/04 166/387

(Continued)

FOREIGN PATENT DOCUMENTS

CA 2215755 8/1998
CA 2210239 C * 11/1998 ..... E21B 33/0415
CA 2355555 C * 7/2008 ..... E21B 33/0355

*Primary Examiner* — Aaron L Lembo
(74) *Attorney, Agent, or Firm* — Bennett Jones LLP

(57) ABSTRACT

A wellhead assembly and a tubing hanger comprising: an outer hanger body for supporting the tubing hanger in a tubing head, the outer hanger body including: an upper end and a lower end; an outer surface having a downwardly tapering shape; an inner bore extending from the upper end to the lower end; a lockdown shoulder; an annular extension between the lockdown shoulder and the upper end of the outer hanger body; and an annular seal extending around an outer diameter of the annular extension, the annular seal configured to seal against debris passing therepast down along the outer surface from the upper end toward the lockdown shoulder when the tubing hanger is supported in a tubing head.

6 Claims, 9 Drawing Sheets

(56) References Cited

U.S. PATENT DOCUMENTS

| | | | | |
|---|---|---|---|---|
| 5,732,772 | A * | 3/1998 | Borak, Jr. | E21B 33/047 166/97.5 |
| 8,272,434 | B2 | 9/2012 | Garcia | |
| 9,562,404 | B2 * | 2/2017 | Klotz | E21B 19/06 |
| 10,443,335 | B2 * | 10/2019 | Finol | E21B 17/043 |
| 11,846,153 | B2 * | 12/2023 | Rodgers | E21B 33/04 |
| 2009/0078404 | A1 * | 3/2009 | Schepp | E21B 33/04 166/75.14 |
| 2021/0189824 | A1 * | 6/2021 | Murphy | E21B 33/043 |
| 2023/0121136 | A1 * | 4/2023 | Hult | E21B 33/0415 166/78.1 |
| 2024/0093564 | A1 * | 3/2024 | Painter | E21B 33/047 |

* cited by examiner

8

TUBING HANGER AND WELLHEAD ASSEMBLY WITH TUBING HANGER

FIELD

The present invention relates to a wellhead assembly and a tubing hanger for hanging a tubing string in a well, and more particularly relates to a wellhead assembly and a tubing hanger with a structure for facilitating removal of the tubing hanger from the tubing head.

BACKGROUND

Various types of tubing hangers are known for hanging a tubing string in a well. Some are rotatable and some are static, not configured for rotation.

Regardless, a tubing hanger is a cylindrical structure that is configured to engage the tubing string to be supported and has a downwardly tapering (i.e. shouldered or frustoconical) outer surface configured to be supported in a tubing head profile, also called a bowl, of a tubing head. The tubing head profile is a downwardly tapering, such as a shouldered or a frustoconically shaped, inner diameter. The tubing hanger is correspondingly tapered on its outer diameter surface to rest in the tubing head. Because the tubing head inner diameter is downwardly tapered and the tubing hanger outer diameter is also downwardly tapered, the tubing hanger is supported in and cannot pass downwardly through the tubing head.

A tubing hanger also includes a lockdown shoulder on its outer surface for receiving lockdown screws or bolts, also called hold down or lag bolts or screws, which hold the tubing hanger from moving upwardly out of the tubing head. In particular, the tubing head includes a plurality of lockdown screws that are threaded through the body of the tubing head and each have a front end exposed in the tubing head profile. The lockdown screws can be threaded forwardly to protrude into the profile or can be threaded back to be withdrawn from the profile. As is known, if it is desired to hold the tubing hanger in the tubing head profile, the lockdown screws are threaded forwardly to protrude above the tubing hanger lockdown shoulder. If it is desired to move the tubing hanger into or out of the tubing head profile, the lockdown screws are threaded back so that they do not protrude into the profile and, therefore, the lockdown screws do not stop the tubing hanger and its lockdown shoulder from being lifted or lowered therepast.

The lockdown shoulder is near or at the upper end of the tubing hanger. For example, often the lockdown shoulder is in fact the upper end of the tubing hanger. The lockdown shoulder, lockdown screws and the interface area around these lockdown components are therefore exposed to debris and corrosive fluids. As a result sometimes, during operations, when it is desired to remove the tubing hanger from the tubing head profile, the tubing hanger is found to be jammed in the profile. In particular, sometimes sanding in on top of the tubing hanger or corrosion of the tubing head and/or tubing hanger, makes the tubing hanger difficult or impossible to remove.

Furthermore, the lockdown screws have a thread just behind their front ends. Corrosion or solids can foul the threads and cause one or more of the lockdown screws to become seized in their threaded ports. This prevents the lockdown screw from being withdrawn, thus making it impossible to remove the tubing hanger from the tubing head. Then, the only remedy is to machine out the one or more seized lockdown screws.

A wellhead assembly is needed that addresses these fouling concerns and therefore facilitates removal of the tubing hanger from the tubing head.

SUMMARY

In accordance with a broad aspect of the present invention, there is provided a wellhead assembly for supporting a tubing string in a well, the wellhead assembly comprising: a tubing head including a tubing head profile extending down from a top end of the tubing head and one or more lockdown screws moveable to a set position protruding into the tubing head profile; and a tubing hanger including an outer hanger body for supporting the tubing hanger in the tubing head profile, the outer hanger body including: an upper end and a lower end; an outer surface having a downwardly tapering shape; an inner bore extending from the upper end to the lower end; a lockdown shoulder; an annular extension between the lockdown shoulder and the upper end of the outer hanger body; and an annular seal extending around an outer diameter of the annular extension, the annular seal sealed against the tubing head profile between the top end and the one or more lockdown screws, thereby to seal against debris passing therepast down along the outer surface from the upper end toward the lockdown shoulder when the tubing hanger is supported in the tubing head.

In accordance with another broad aspect of the present invention, there is provided a tubing hanger comprising: an outer hanger body for supporting the tubing hanger in a tubing head, the outer hanger body including: an upper end and a lower end; an outer surface having a downwardly tapering shape; an inner bore extending from the upper end to the lower end; a lockdown shoulder; an annular extension between the lockdown shoulder and the upper end of the outer hanger body; and an annular seal extending around an outer diameter of the annular extension, the annular seal configured to seal against debris passing therepast down along the outer surface from the upper end toward the lockdown shoulder when the tubing hanger is supported in a tubing head.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF EMBODIMENTS

The detailed description set forth below in connection with the appended drawings is intended as a description of various embodiments of the present invention and is not intended to represent the only embodiments contemplated by the inventor. The detailed description includes specific details for providing a comprehensive understanding of the present invention. However, it will be apparent to those skilled in the art that the present invention may be practiced without these specific details.

Figure 1:
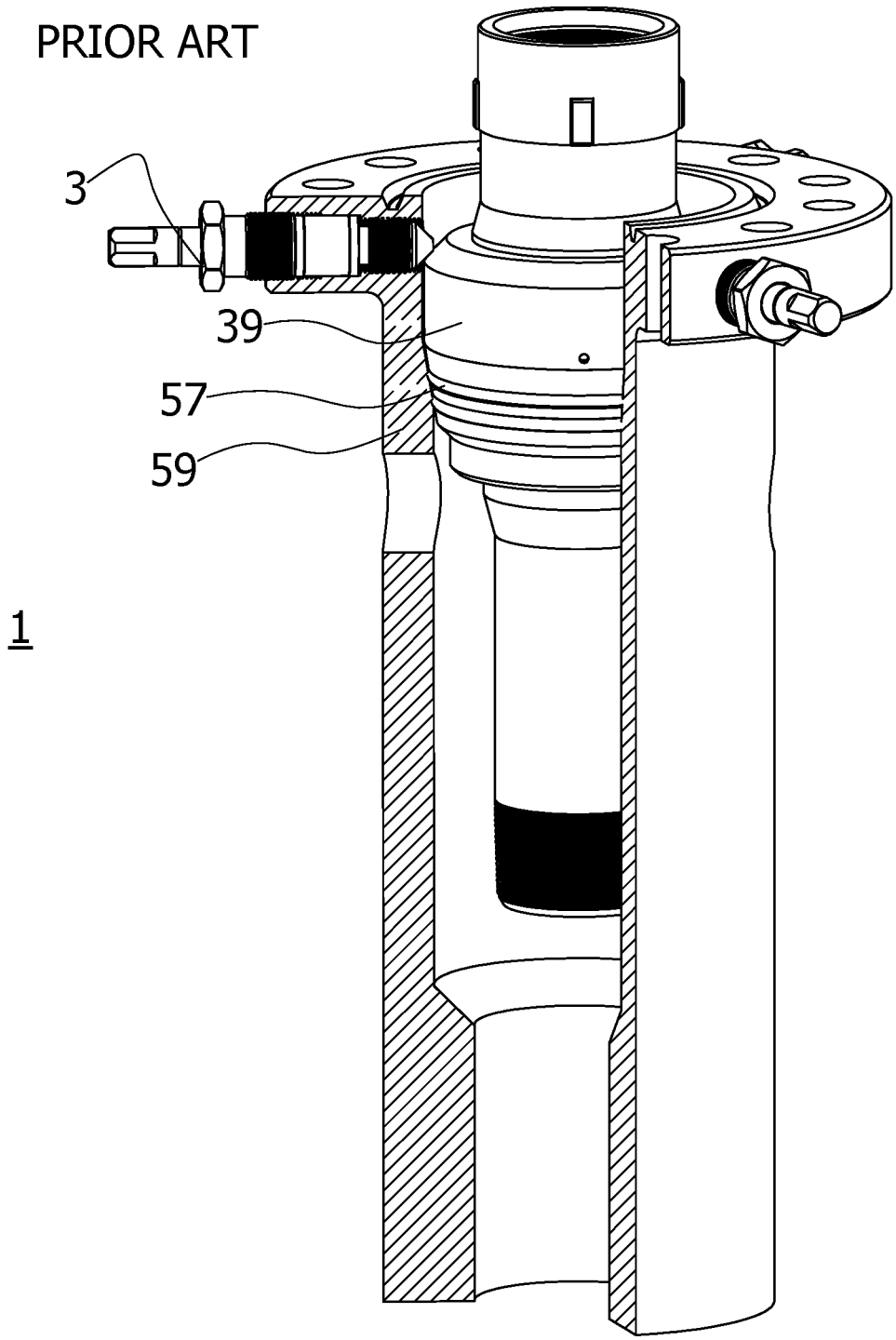
FIG. 1 PRIOR ART
FIG. 1 is a side perspective view, partially cut away, of a prior art wellhead assembly for supporting a tubular string in a well.

FIG. 1 depicts one embodiment of a prior art wellhead assembly 1. The wellhead assembly includes a tubing hanger 39 supportable in a tubing head 59.

Figure 2:
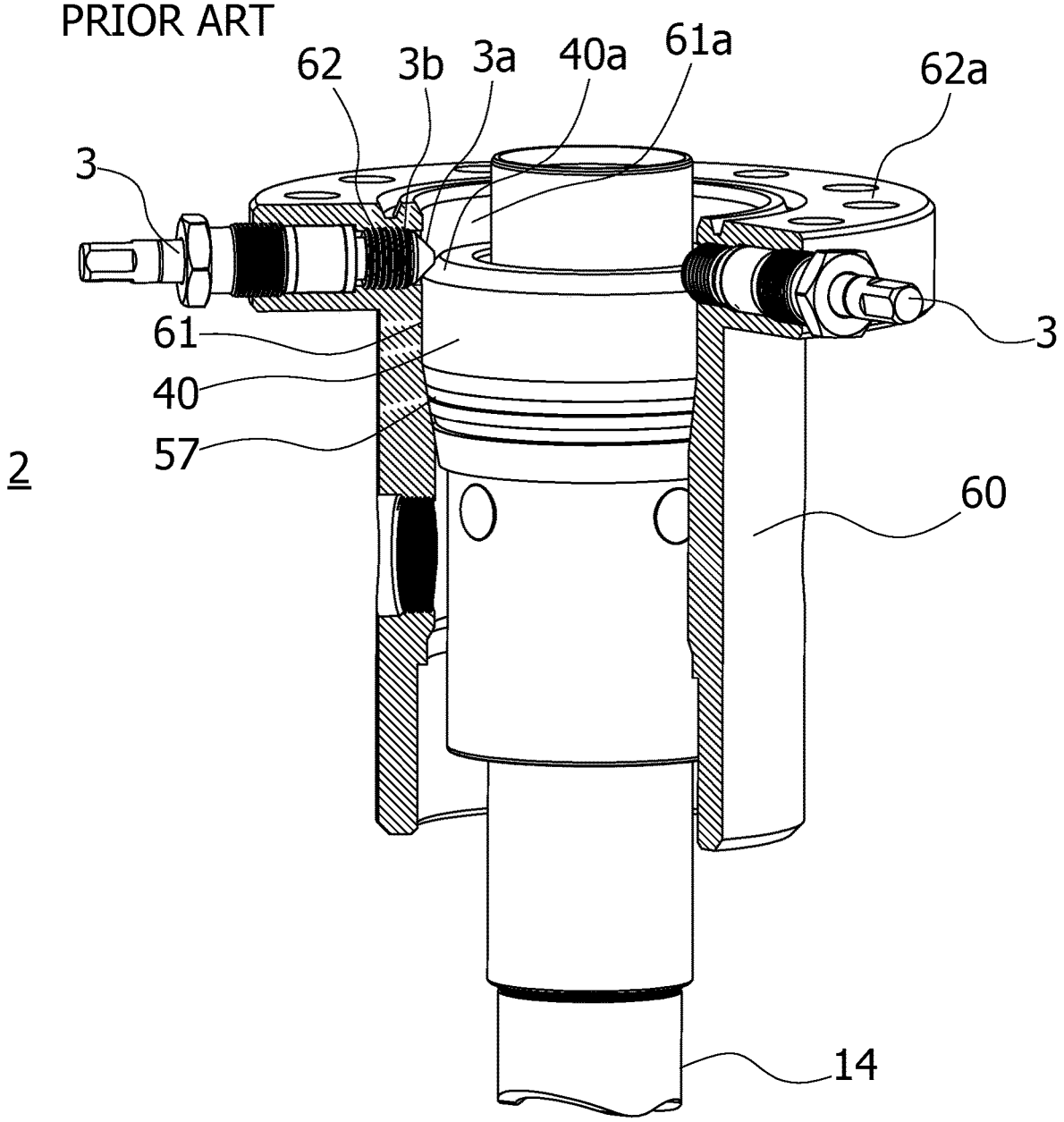
FIG. 2 PRIOR ART
FIG. 2 is a side perspective view, partially cut away, of another prior art wellhead assembly for supporting a tubular string in a well.

FIG. 2 depicts another embodiment of a prior art wellhead assembly 2. Wellhead assembly 2 also includes a tubing hanger 40 supportable in a tubing head 60. Using FIG. 2 as an example, tubing head 60 is fluidly sealed directly or indirectly to a wellbore casing (not shown). For example, the tubing head can be attached by bolts to a casing head or the casing head is not used and instead, the tubing head is coupled onto the casing, by threading or welding.

Tubing head 60 is configured with an inner open area with a diameter constriction to support tubing hanger 40. This illustrated tubing head is for an A-type hanger and has a generally frustoconical, gradually downwardly tapering inner surface that defines a profile 61, sometimes called a bowl. There are other configurations with a more abrupt tapering. For example, a tubing head profile for a CT-type hanger has substantially straight cylindrical upper side walls and a beveled, annular shoulder tapers the inner diameter inwardly. Generally, the beveled shoulder is near the bottom of the profile. The CT tubing hanger has a corresponding beveled, inwardly tapering annular shoulder on its lower end that rests on the beveled shoulder in the profile.

Tubing hanger 40 is configured to support a tubing string 14 and has an outer surface that is downwardly tapered to be supported in the tubing head profile 61. Tubing hanger 40 may include seals 57 on its outer surface that seal in the interface between the profile 61 and the tubing hanger outer surface.

One or more lockdown screws 3 may be used to secure the tubing hanger 40 within the tubing head 60. When a lockdown screw is set, its front end 3*a* protrudes above a lockdown shoulder 40*a* of the tubing hanger and prevent upward movement of the tubing hanger relative to the tubing head. The upward movement may, for example, be in response to high fluid pressure from below.

Each lockdown screw 3 is installed in a threaded port 62 that extends through a side wall, such as through the flange, of the tubing head 60. If there are a plurality of lockdown screws, they are spaced apart about the circumference of the profile 61 and threaded ports 62 are all positioned at the same depth from the upper end of the tubing head. A portion of the tubing head inner wall, which is integral with and an extension of the inner wall defining the profile 61, extends above the threaded ports 62. In other words, there is annular portion 61*a* of the profile of the tubing head that is positioned between the threaded ports 62 and the upper limit, which in this embodiment is flange face 60*a*, of the tubing head.

As will be better appreciated, in prior art wellhead assemblies, lockdown shoulder 40*a*, lockdown screws 3 and the interface area around these lockdown components are exposed to debris and corrosive fluids from above. As a result sometimes, during operations, when it is desired to remove the tubing hanger 40 from the tubing head profile 41, the tubing hanger is found to be jammed in the profile.

For example, sometimes debris moves down past annular wall portion 61*a* and sands in on top of the tubing hanger. This debris can migrate down into the interface between tubing hanger 40 and profile 61 down to seals 57. This debris makes the tubing hanger difficult or impossible to remove.

Furthermore, corrosion or solids can foul the threads 3*b* just behind the front ends 3*a* of screws 3 and can cause one or more of the lockdown screws to become seized in their threaded ports 62. This prevents the lockdown screw from being withdrawn, thus making it impossible to remove the tubing hanger from the tubing head. Then, the only remedy is to machine out the one or more seized lockdown screws.

Wellheads and tubing hangers can take various forms, as can be appreciated by comparing hanger 39 to hanger 40, but typically the above applies equally to many types of hangers.

FIGS. 3 to 9 show a few types of wellheads and tubing hangers all according to the present invention, which are configured to overcome the prior difficulties of the tubing hanger becoming stuck in the tubing head.

Figure 3:
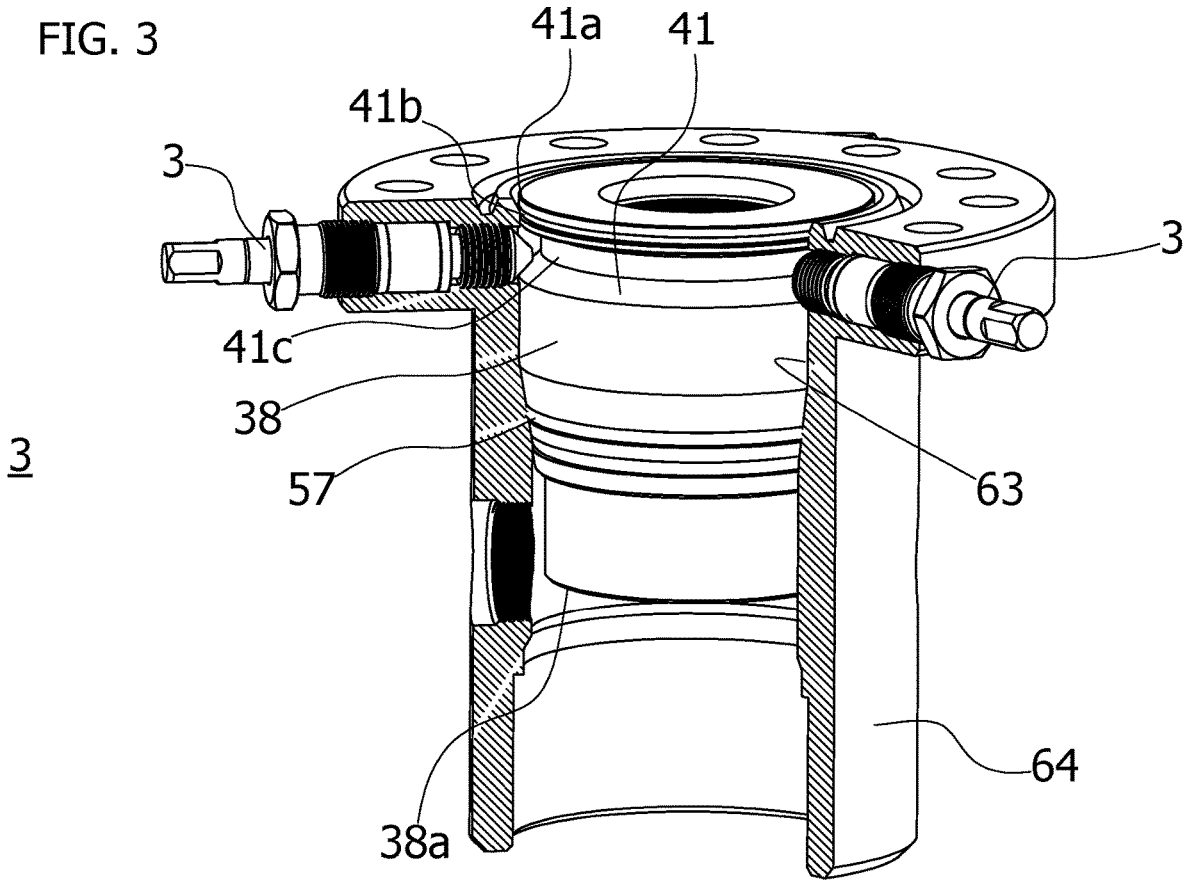
FIG. 3 is a side perspective view, partially cut away, of a wellhead assembly according to the present invention for supporting a tubular string in a well.

FIG. 3, for example, illustrates a wellhead assembly 3 with a static, non-rotatable tubing hanger 38 supported in a profile 63 of a tubing head 64. A lower end 38*a* of the tubing hanger 38 is configured, for example as by threading, to connect to a tubing string (not shown) that is to be supported by the wellhead assembly.

Figure 4:
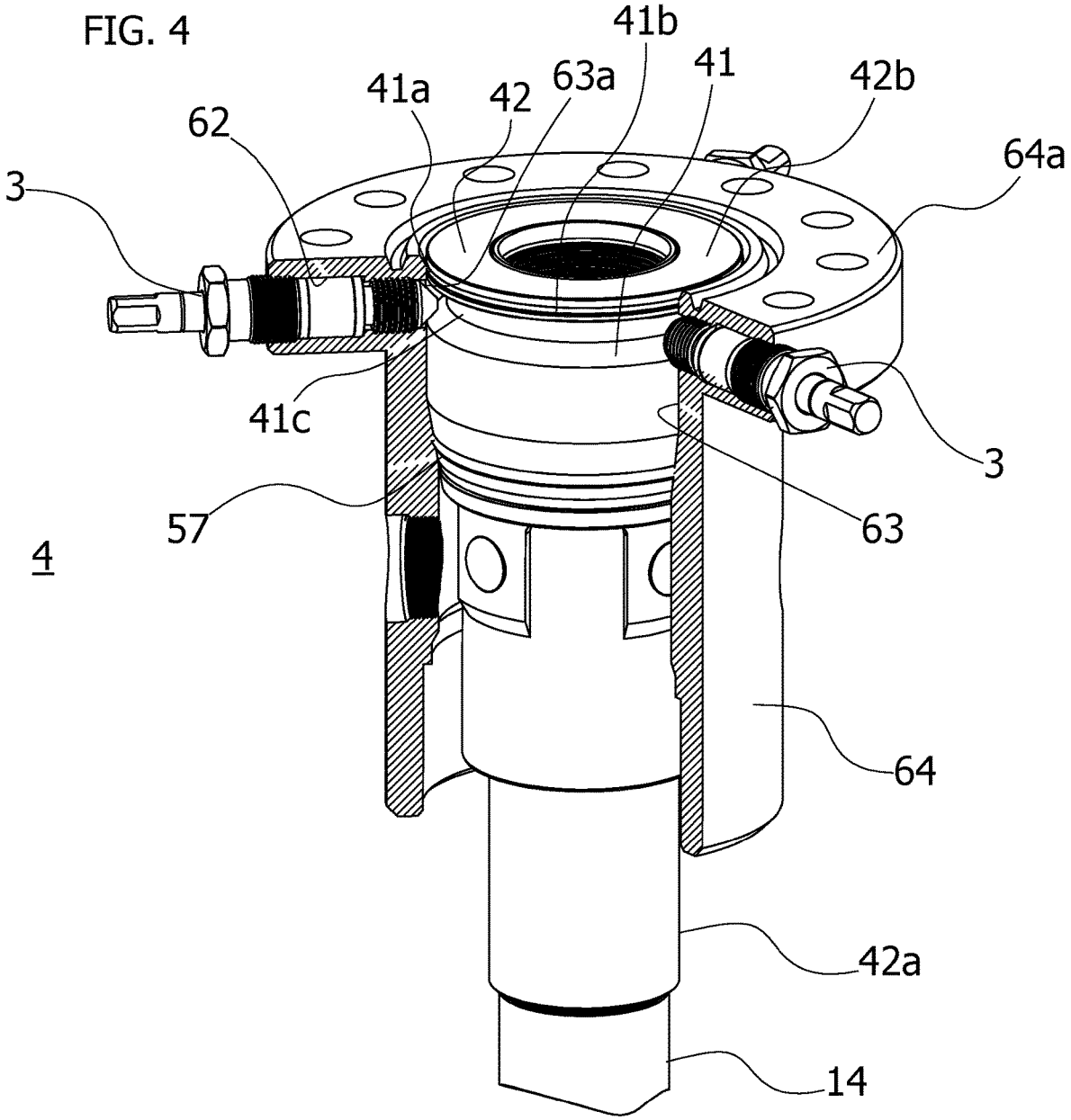
FIG. 4 is a side perspective view, partially cut away, of a wellhead assembly according to the present invention for supporting a tubular string in a well.
Figure 5:
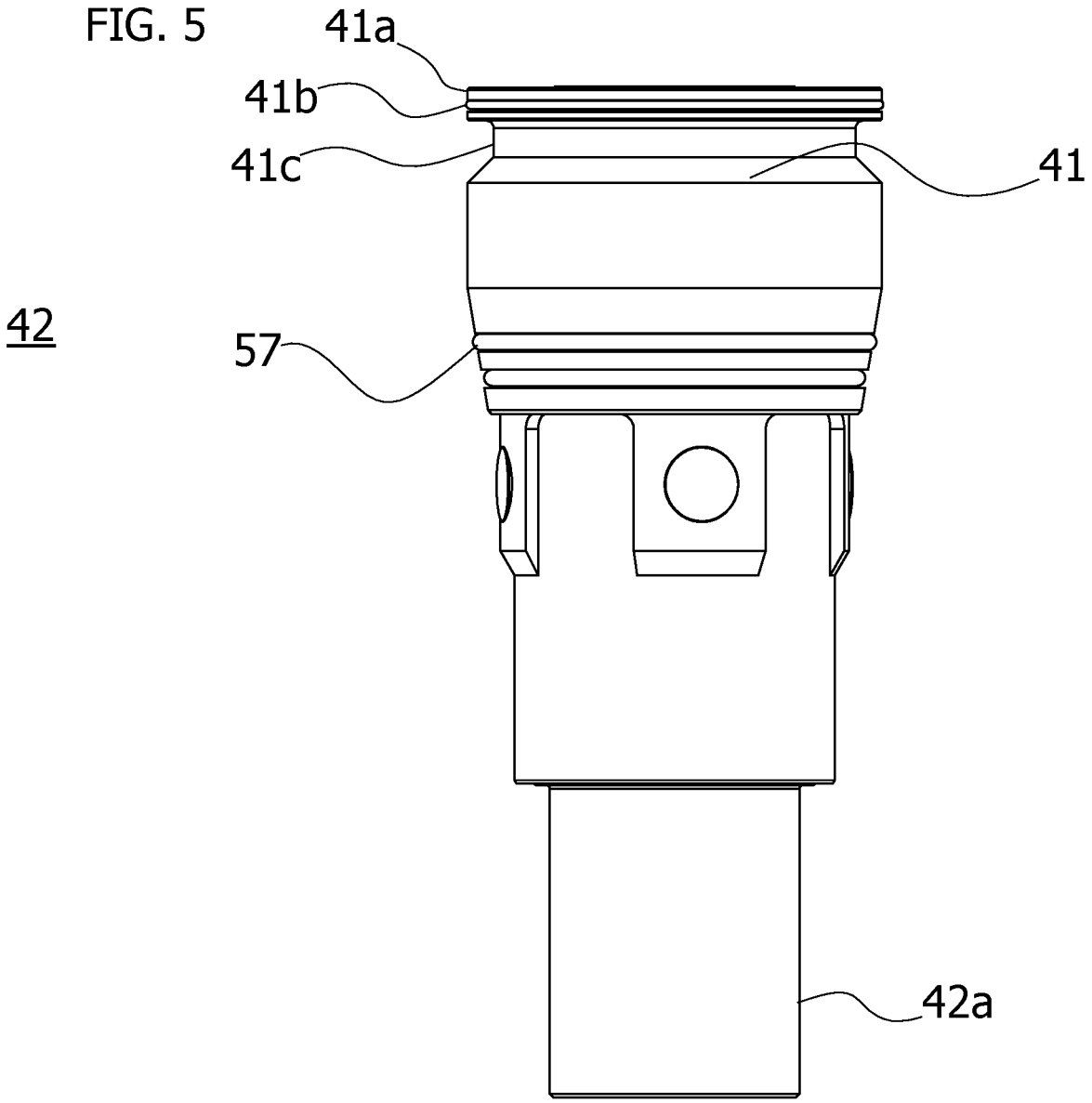
FIG. 5 is a side elevation view of the tubing hanger from the assembly of FIG. 4.

Another wellhead assembly with a static, non-rotatable tubing hanger is illustrated in FIGS. 4 and 5. In this example, a wellhead assembly 4 has a static, non-rotatable tubing hanger 42 that is supportable in a profile 63 of a tubing head 64. In one embodiment, tubing hanger 42 may have a two part construction with (i) an outer hanger body 42*b* that defines the outer, downwardly tapering surface of the tubing hanger, carries seals 57, is supported in the profile 63 and has a through bore and (ii) a mandrel that is positioned concentrically within the inner bore of the outer hanger body. In such an embodiment, lower end 42*a* is a lower end of the mandrel and the mandrel may be rotatable within the outer hanger body. In one embodiment, for example, the mandrel and the outer hanger body may be coupled via a j-slot such that tension may be pulled into the tubing string 14 by manipulating the mandrel while the outer hanger body remains set in the tubing head.

Figure 6:
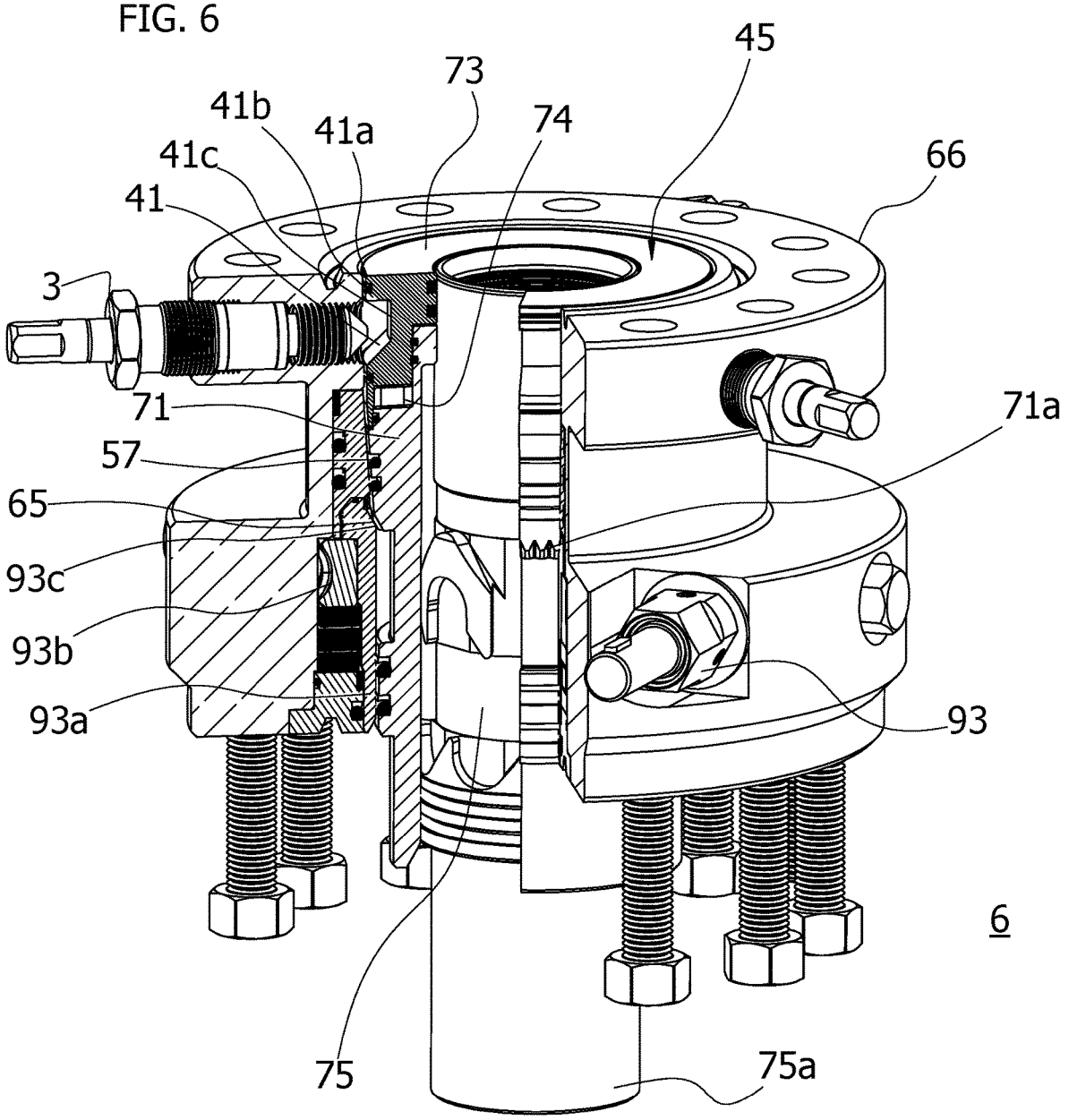
FIG. 6 is a side perspective view, partially cut away, of a wellhead assembly according to the present invention for supporting a tubular string in a well.
Figure 7:
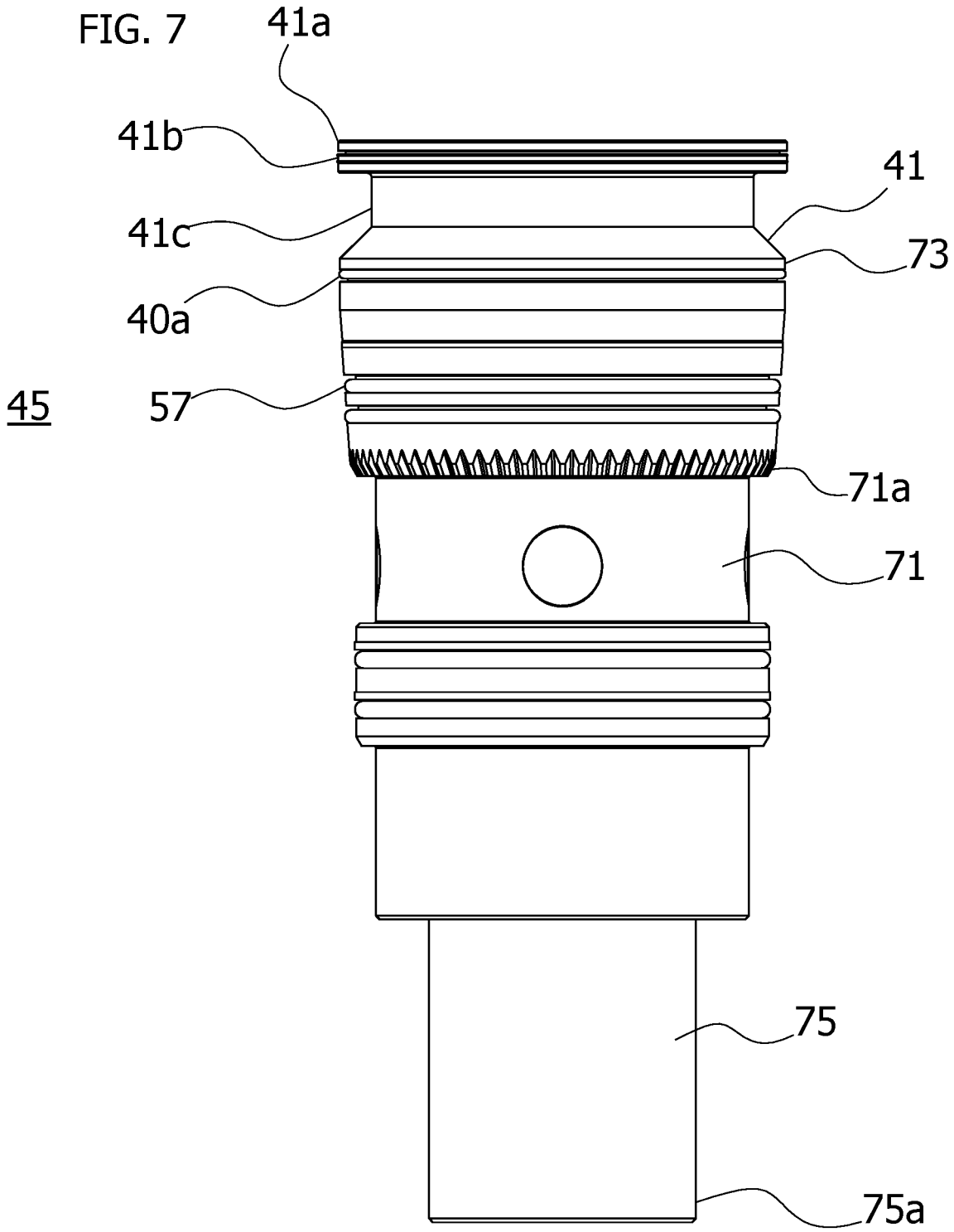
FIG. 7 is a side elevation view of the tubing hanger from the assembly of FIG. 6.

FIGS. 6 and 7, for example, illustrate a wellhead assembly 6 with a rotatable tubing hanger 45 supported in a profile 65 of a tubing head 66. Tubing hanger 45 is rotatable, which means it is configured to receive torque and allow tubing rotation from a tubing rotator 93. In this embodiment, tubing head 66 and rotator 93 are integral and may be positioned on a wellhead. In one embodiment, where the wellhead includes an existing tubing head, the combined tubing head and rotator may be installed above the existing tubing head, as by use of a lower flange connection.

In such an embodiment, tubing hanger 45 includes an outer hanger body that includes parts 71, 73 that permit it to receive and transmit a rotary drive from tubing rotator 93 to a tubing string (not shown) connected at lower end 75*a*. For example, outer hanger body 45*b* can include a rotatable portion 71 and a static, support portion 73. There may be a bearing 74 (as shown), a space or a bushing, to facilitate interactions between rotatable portion 71 and static portion 73.

While rotatable portion could be connectable directly to the tubing string, in this embodiment, tubing hanger 45 includes a further part: mandrel 75. Static, support portion 73 and rotatable portion 71 are each annular and together encircle the mandrel. Mandrel 75, in this illustrated embodiment, is coupled concentrically within the rotatable portion 71 and supports connection of the tubing string (not shown) at its lower end 75*a*. Mandrel 75 and rotatable portion 71 are coupled via a pin and j-slot coupling, such that torque applied to rotatable portion 71 can be transmitted to the mandrel 75. However, the inner mandrel 75 can be locked, via its slots, onto the pins or the inner mandrel can be unhooked from the pins and moved axially inside the rotatable portion 71. As noted above, the axial movement of the mandrel within the outer hanger body including, rotatable portion 71, allows pulling tension in the tubing string, such as to permit the setup of a tubing anchor. After adjustment of the string, the mandrel can be engaged onto the pins of the rotatable portion 71, thereby transmitting the hanging load to parts 71, 73 and, therethrough, to the tubing head 66.

As noted, the embodiment of FIGS. 6 and 7 operates with tubing rotator 93, which is integral with tubing head 66. In this embodiment, the tubing profile 65 is configured in part as a rotator bowl 93*a* that is driven to rotate about the long axis through profile 65 by a worm gear that engages in planetary gear 93*b* coupled on a backside of rotator bowl 93*a*. Also, rotatable portion 71 includes a toothed exterior ring 71*a*. Toothed exterior ring 71*a* is configured to be meshed and to rotate with rotator bowl 93*a*. In particular, the inner diameter of rotator bowl 93*a* has an annular arrangement of teeth 93*c* into which the toothed exterior ring 71*a* can land and mesh. During rotation of rotator bowl 93*a* by the worm gear, the teeth 93*c* engage and drive against ring 71*a* to rotate rotatable portion 71. Other types of torque transmission from the rotator 93 to the outer hanger body are possible such as splines, teeth, keys, slots and other means of transmitting torque.

This rotation occurs while static, support portion 73 remains positioned above rotatable portion 71 and is non-rotatable in profile 65.

Figure 8:
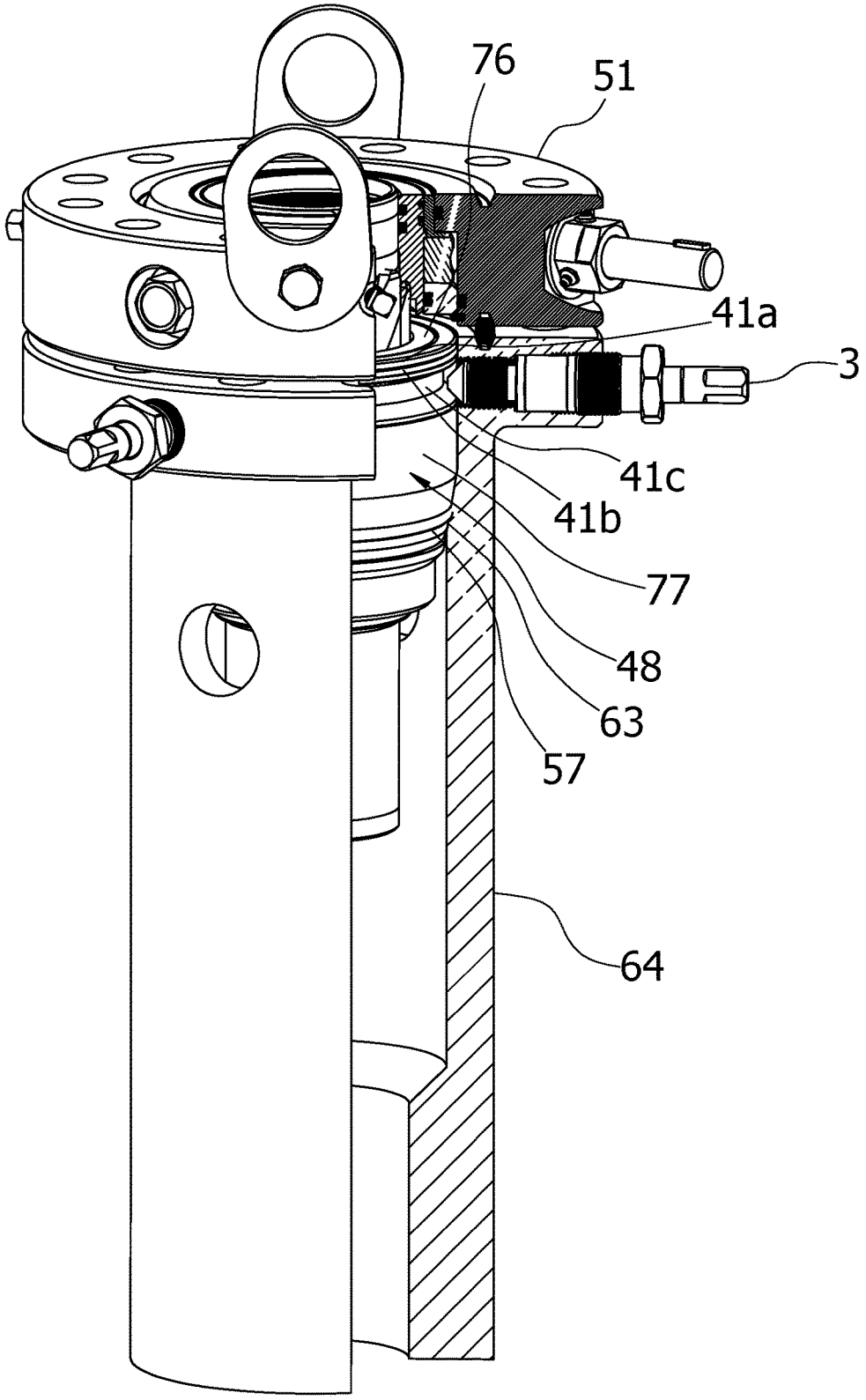
FIG. 8 is a side view, partially cut away, of a wellhead assembly according to the present invention for supporting a tubular string in a well.
Figure 9:
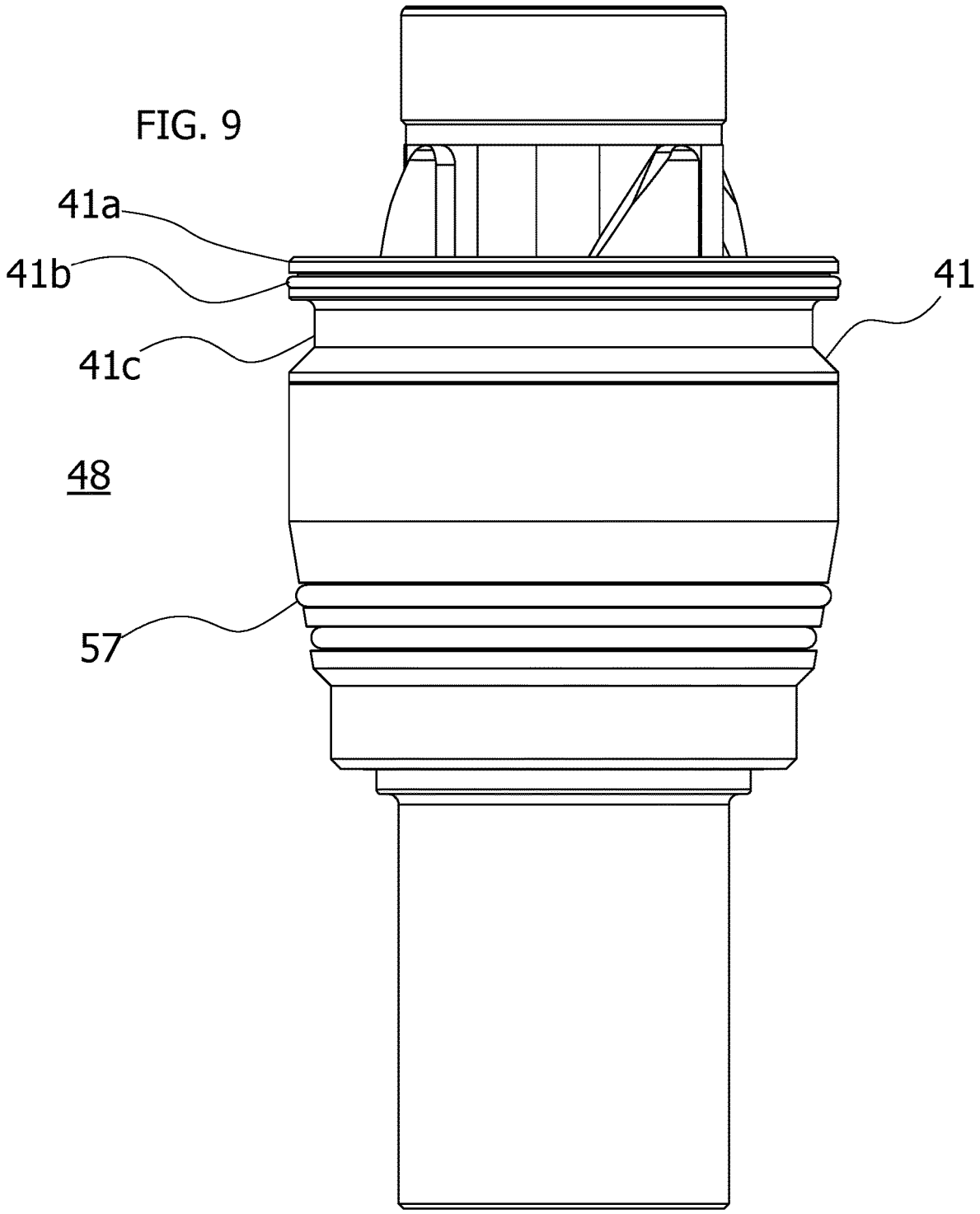
FIG. 9 is a side elevation view of the tubing hanger from the assembly of FIG. 8.

Also, with reference to FIGS. 8 and 9, another example of a wellhead assembly is illustrated with a rotatable tubing hanger supportable in tubing profile 63 of a tubing head 64. In the illustrated assembly 8, tubing hanger 48 is able to accommodate rotation of the string when string weight is supported, as driven by a tubing rotator 51. In this particular illustrated embodiment, the tubing hanger 48 includes an outer hanger body with a thrust bearing between a rotatable portion 76 and a support portion 77. The tubing hanger also includes a mandrel 78 that is positioned concentrically within and coupled to the rotatable portion 76. The mandrel is engaged and rotated at its upper end by tubing rotator 51 and the rotation is accommodated by rotatable portion, as permitted by the thrust bearing.

This rotation occurs while support portion 77 remains static relative to profile 63.

While four different wellhead assemblies and tubing rotators are described here as examples, regardless all include a configuration to facilitate removal of the tubing hanger, when desired, from the tubing head. In particular, each of the tubing hangers include a lockdown shoulder 41 for accommodating thereabove the lockdown screws 3, but also include an annular extension 41*a* of the tubing hanger above the lockdown shoulder and a seal ring 41*b* installed on annular extension 41*a*. The seal ring 41*b* is configured to seal the interface between the tubing hanger and the tubing head profile when the tubing hanger is in place, supported in the tubing head with lockdown screws 3 protruding above the shoulder 41. Seal 41*b* has an outer diameter and is positioned to land and seal against the annular portion between the screws 3 and the upper limit, for example flange surface of the tubing head. Referring to FIG. 4, for example, seal 41*b* is configured to seal against the annular portion 63*a* and to create a full annular seal around the tubing hanger orthogonal to the long axis top to bottom of the hanger. The seal 41*b* becomes positioned between the ports 62 for screws 3 and the upper limit 64*a*, for example the flange surface, of the tubing head.

Thus, seal 41*b* extends around the outer diameter surface of the tubing hanger and prevents debris and gas from migrating down to the lockdown screws 3, shoulder 41 and the interface between the tubing head profile and the tubing hanger. In addition, lower seals 57 prevent gases from migrating up to the lockdown screws 3 and shoulder 41. Therefore, the difficulties of jamming and seizing of screws 3 is avoided.

In one embodiment, annular extension 41*a* is a cylinder that extends up beyond shoulder 41 and extends the upper end of the tubing hanger. The annular extension may radially project outwardly to create a groove 41*c* concentrically around the tubing hanger, where shoulder 41 defines a lower limit of the groove 41*c*. Groove 41*c* has a depth to accommodate the front end of screws 3 in their protruded position.

Seal 41*b* is positioned in a gland that encircles annular extension 41*a* and extends concentrically around the tubing hanger adjacent its upper end. Seal 41*b* may, for example, be an O-ring.

Extension 41*a* and seal 41*b* may be integral to a static portion of the tubing hanger. For example, with reference to the embodiments of FIGS. 6-9, while these embodiments include rotatable hanger portions, shoulder 41, extension 41*a* and seal 41*b* are on support portions 73 and 77, which are each static, non-rotatable relative to the tubing head. Therefore, the seal 41*b* is protected against damage and wear.

The tubing hanger with extension 41*a* and seal 41*b* can readily be employed with most tubing heads, since the sizes and outer diameter dimensions of the extension and seal can be selected to seal against the annular wall portion between the screw ports 62 and the upper limit of the tubing head. To best protect against problems with jamming and seizing, the seal 41*b* should be positioned to seal directly against a portion of the profile wall, in particular a portion of the profile wall that is integral with the profile wall through which the screws protrude.

Although specific embodiments of the invention have been described herein in some detail, this has been done solely for the purposes of explaining the various aspects of the invention, and is not intended to limit the scope of the invention as defined in the claims that follow. Those skilled in the art will understand that the embodiment shown and described is exemplary, and various other substitutions, alterations and modifications, including but not limited to those design alternatives specifically discussed herein, may be made in the practice of the invention without departing from its scope.

The invention claimed is:

1. A tubing hanger comprising:

an outer hanger body for supporting the tubing hanger in a tubing head, the outer hanger body including:

an upper end and a lower end;

an outer surface having a downwardly tapering shape at the lower end, the downwardly tapering shape configured for resting on a shoulder in the tubing head;

an inner bore extending from the upper end to the lower end;

a lockdown shoulder adjacent the upper end;

an annular extension between the lockdown shoulder and the upper end of the outer hanger body; and an annular seal extending around an outer diameter of the annular extension, the annular seal being an o-ring in an annular gland and being configured to seal against debris and fluids passing therepast down along the outer surface from the upper end toward the lockdown shoulder when the tubing hanger is supported in a tubing head.

2. The tubing hanger of claim 1 wherein the annular extension projects radially outwardly above the lockdown shoulder and a groove is defined between the annular extension and the lockdown shoulder.

3. The tubing hanger of claim 1 wherein the outer hanger body includes a support portion, a rotatable portion and a bearing permitting rotation of the rotatable portion relative to the support portion; and the lockdown shoulder, the annular extension and the annular seal are on the support portion.

4. A wellhead assembly comprising:

a tubing head including a tubing head profile extending down from a top end toward a bottom end of the tubing head and defining a shoulder adjacent the bottom end and one or more lockdown screws adjacent the top end and being moveable to a set position protruding into the tubing head profile; and a tubing hanger including an outer hanger body for supporting the tubing hanger in the tubing head profile, the outer hanger body including:

an upper end and a lower end;

an outer surface having a downwardly tapering shape at the lower end, the downwardly tapering shape resting on the shoulder in the tubing head;

an inner bore extending from the upper end to the lower end;

a lockdown shoulder adjacent the upper end;

an annular extension between the lockdown shoulder and the upper end of the outer hanger body; and an annular seal extending around an outer diameter of the annular extension, the annular seal being an o-ring in an annular gland and being sealed against the tubing head profile between the top end and the one or more lockdown screws, thereby to seal against debris and fluids passing therepast down along the outer surface from the upper end toward the lockdown shoulder when the tubing hanger is supported in the tubing head.

5. The wellhead assembly of claim 4 wherein the annular extension projects radially outwardly above the lockdown shoulder and a groove is defined between the annular extension and the lockdown shoulder.

6. The wellhead assembly of claim 4 wherein the outer hanger body includes a support portion, a rotatable portion and a bearing permitting rotation of the rotatable portion relative to the support portion; and the lockdown shoulder, the annular extension and the annular seal are on the support portion.

* * * * *